US007128286B2

(12) United States Patent
Chaney et al.

(10) Patent No.: US 7,128,286 B2
(45) Date of Patent: Oct. 31, 2006

(54) DOUBLE DISK REFINER, STOCK INDUCER THEREFOR AND METHOD OF REFINING LOW CONSISTENCY STOCK

(75) Inventors: Michael R. Chaney, Brookfield, WI (US); Ulf B. Reinhall, Mukwonago, WI (US); Thomas J. Kehn, Troy, NY (US)

(73) Assignee: J&L Fiber Services, Inc., Waukesha, WI (US)

( * ) Notice: Subject to any disclaimer, the term of this patent is extended or adjusted under 35 U.S.C. 154(b) by 248 days.

(21) Appl. No.: 10/339,468

(22) Filed: Jan. 9, 2003

(65) Prior Publication Data

US 2003/0155457 A1 Aug. 21, 2003

Related U.S. Application Data

(60) Provisional application No. 60/347,111, filed on Jan. 9, 2002.

(51) Int. Cl.
*B02C 7/11* (2006.01)

(52) U.S. Cl. ..... 241/247; 241/261.2; 241/297

(58) Field of Classification Search ..... 241/296, 241/297, 298, 245, 246, 247, 261.2, 261.3
See application file for complete search history.

(56) References Cited

U.S. PATENT DOCUMENTS

| | | | | |
|---|---|---|---|---|
| 782,293 | A * | 2/1905 | Warner | 241/296 |
| 1,123,494 | A * | 1/1915 | Craig | 241/259.3 |
| 2,172,151 | A | 9/1939 | Dick | |
| 2,968,444 | A * | 1/1961 | Jones | 241/163 |
| 3,441,227 | A | 4/1969 | Fisher | |
| 3,893,631 | A | 7/1975 | Fisher et al. | |
| 4,036,443 | A * | 7/1977 | Saltarelli | 241/297 |
| 4,223,847 | A * | 9/1980 | Tantalo et al. | 241/247 |
| 4,253,613 | A | 3/1981 | Reinhall | |
| 4,269,365 | A * | 5/1981 | Berggren | 241/152.2 |
| 4,283,016 | A | 8/1981 | Reinhall | |
| 4,401,280 | A | 8/1983 | Reinhall | |
| 4,610,400 | A | 9/1986 | Sjobom | |
| 5,076,892 | A | 12/1991 | Fisher et al. | |
| 5,383,608 | A | 1/1995 | Dahiqvist et al. | |
| 5,626,300 | A | 5/1997 | Kohler | |
| 5,947,394 | A * | 9/1999 | Egan et al. | 241/30 |

OTHER PUBLICATIONS

Sprout-Bauer Twin-Flo III Refiners photo, undated.

(Continued)

*Primary Examiner*—Mark Rosenbaum
(74) *Attorney, Agent, or Firm*—Michael Best & Friedrich LLP

(57) ABSTRACT

A double disk refiner and inducer for the same that mixes fiber in low consistency (6% or less by weight) stock and urges it towards both pairs of refiner disks of the double disk refiner. In a preferred embodiment, the inducer comprises an impeller that has at least one flight extending radially outward from an inner hub. Each flight is angled and also can be curved so as to substantially continuously mix and urge stock toward the disks. In one preferred embodiment, the inducer is an impeller that has two helical flights that are axially spaced from one another but that overlap in an axial direction. In a preferred method, the low consistency stock is urged by the inducer toward the disks preventing clumping of fibers in the stock and breaking up any clumps already present in the stock. As a result, the gap between the disks can be increased from between one thousand and three thousandths of an inch to increase the output of the refiner.

34 Claims, 8 Drawing Sheets

OTHER PUBLICATIONS

Sprout-Bauer Twin-Flo III Refiners drawing, undated.
DD 3000 Refiner Parts drawing with labeled parts, J & L Fiber Services, Inc., undated.
DD 4000 Refiner Parts drawing with labeled parts, J & L Fiber Services, Inc., undated.

* cited by examiner

DOUBLE DISK REFINER, STOCK INDUCER THEREFOR AND METHOD OF REFINING LOW CONSISTENCY STOCK

CROSS REFERENCE TO RELATED APPLICATIONS

This application claims priority from U.S. Provisional Patent Application Serial No. 60/347,111, which was filed on Jan. 9, 2002, the entirety of which is expressly incorporated herein.

FIELD OF THE INVENTION

The present invention relates to a device for facilitating flow of low consistency fibrous stock into refining zones of a double disk refiner, more particularly to an inducer carried by a rotor that is common to both rotating refining surfaces of a double disk refiner, and a method of facilitating more uniform flow of low consistency stock into both refining zones of a double disk refiner.

BACKGROUND OF THE INVENTION

In the papermaking industry, disk refiners are utilized to refine stock as an initial step in the papermaking process. Stock flows into an inlet of the refiner and then passes between a pair of refiner disks, one of which rotates with respect to the other disk, to refine the stock.

Initially, rather massive fibrous clumps, typically in the form of wood chips, are disposed in a liquid stock slurry such that the consistency of the stock is thick with fibrous matter and referred to as high consistency stock. To help soften the chips so they more easily break apart during refining, they are heated and chemically treated in a tank called a digester before refining.

High consistency stock is refined by refiners specifically setup to handle breaking up such large chips apart into smaller components. Refiners are typically staged so as to progressively break the fibrous matter into increasingly smaller components with the desire that the stock will be almost entirely composed of individual fibers entrained in liquid by the time the stock reaches a paper machine or fiber product making apparatus. Liquid is typically added to the stock at each stage to dilute the fibrous matter so it can more easily pass through increasingly narrower refiner disk gaps required to refine the fibrous matter into ever-smaller components.

As the fibrous matter becomes more diluted and smaller in size, the consistency of the stock is correspondingly reduced. At some point, the percentage of fibrous matter becomes six percent or less, and the stock is defined as being low consistency stock. One desired goal of refining that takes place at or after this point is to refiner the fibrous matter into individual fibers that are fibrillated so they more tightly engage each other when the fibers are formed into a sheet of paper or some other like fiber product. This increases finished product strength, while enabling ever-higher production rates to be achieved.

Stock feed assist devices have been employed in the past in high consistency refining applications to help force the relatively thick stock into the gap between refiner disks of a high consistency refiner. Since fibrous matter of high consistency stock consists of relatively large fibrous components, typically wood chips, refining of high consistency stock usually generates so much heat that a considerable amount of steam is produced. Such feed assist devices are also employed to help overcome the opposition to stock flow due to the pressure of steam seeking to escape the refining zone against the direction of flow. Some examples of feed assist devices used in high consistency refiners are disclosed in U.S. Pat. Nos. 5,076,892, 5,383,608, and 5,626,300.

It is believed that feed assist has not been heretofore been used in low consistency refining applications. Since low consistency stock is comprised almost entirely of liquid and a small amount of fiber, steam does not adversely impact the flow of entering stock anywhere near the same degree as it does in high consistency refining, employing any kind of feed assist in a low consistency refiner application was not heretofore believed to significantly impact low consistency refining.

One type of refiner that is used in low consistency refining applications is a double disk refiner. A double disk refiner has an inlet through which stock flows into a first refining zone that is located closest to the inlet and a second refining zone located downstream of the first refining zone. A double disk refiner includes a rotor that carries a pair of refining surfaces that face away from each other with each of these refining surfaces, in turn, opposing a stationary refining surface, defining refining zones therebetween. The rotor includes a perforate hub through which some stock entering the refiner must flow to reach the second refining zone, which is located downstream of the hub.

As a result of this construction, low consistency stock flow conditions are complex and believed not heretofore fully understood. For example, stock passing through the perforate hub drops in pressure. This is believed to occur at least in part because some of the stock flowing toward to second refining zone impacts the hub before it reaches the second refining zone. This dissipates some of the energy of the stock, which thereby decreases its velocity before it enters the second refining zone. As such, its velocity is less than the velocity of the stock flowing into the first refining zone. Additionally, the fluid shearing action of the hub rotating generally perpendicular to stock flow, creates flow disturbances that include wakes, flow-opposing cavitation, turbulence, as well as localized pressure differences in the stock along the hub that can further reduce the rate of stock flow into the second refining zone.

It is also believed not heretofore understood the full extent how such flow conditions and the double disk refiner geometry also impacts the distribution of fiber of low consistency stock entering the refiner. For example, despite the fact that no more than six percent of low consistency stock is comprised of fiber, it has not been heretofore well understood about how to best disperse fiber that tends to agglomerate in double disk refiners between the stock inlet and both refining zones as a result.

Thus, in the past, performance of double disk refiners in low consistency refining applications has been less than optimal. For example, the aforementioned fiber agglomeration causes fiber entering each refining zone to be nonuniformly distributed, which, for example, typically manifests itself in an undesirably high amount of shives. Shives are bundles of fibers still bound together (such as by lignin), which are discharged by the refiner. These are undesirable as they are much larger than desired and tend not to be fibrillated enough to adequately engage other surrounding fibers when sheet forming takes place.

In the past, a double disk refiner of Sprout-Bauer, Inc., marketed under the trade name Twin-Flo III, was equipped with a pair of agitator assemblies carried on the rotor drive shaft that were each intended to break up clumps in low consistency stock. Each agitator assembly is a circular collar clamped on the shaft for rotation in unison therewith having a pair of square tabs that each extends out from the collar into stock located adjacent one of the refining zones of the double disk refiner. One agitator assembly is located at the end of a stock inlet conduit and just upstream of both refining zones. The second agitator assembly is located downstream of both refining zones in a stock-receiving pocket.

Unfortunately, rotation of the square tabs of each agitator assembly creates retarding eddies and turbulence that can adversely impact stock flow, which can actually cause clumping. In particular, the agitator assembly located upstream of both refining zones actually decreases stock flow and can actually cause stock backflow out of the first refining zone back toward the inlet. The shape of each of agitator assembly tab and the orientation each tab relative to the intended direction of stock flow impedes flow to both refining zones and also has virtually no impact in preventing the hub from impeding flow to the second refining zone. As a result, the volume of shives outputted by a low consistency double disk refiner so equipped remains undesirably high, energy efficiency is less than optimal as a result of the increased energy dissipated by each agitator assembly, and refiner throughput via both refining zones is less than ideal.

What is needed is an improved double disk refiner, low consistency stock arrangement for such a refiner that helps maximize uniformity of the distribution of fiber in stock entering each refining zone of the refiner, and an improved low consistency stock refining method.

SUMMARY OF THE INVENTION

In accordance with a preferred aspect of the present invention, a refiner for in refining low consistency stock is provided with an inducer that is coupled to a rotating shaft used to rotate one of each pair of refiner disks positioned within the refiner.

According to another aspect of the present invention, the rotation of the inducer imparts at least a slight spin or rotation to flow of the incoming low consistency stock such that the flow characteristics, such as fibrous matter momentum of a plurality of fibrous matter entrained in the stock, are desirably altered in a manner that helps prevent agglomeration while also helping to break up already formed clumps. Even where an inducer constructed in accordance with the invention does not impart such a spin or rotation to flow, the inducer more evenly distributes individual fibers in low consistency stock through a mixing action, which improves refining quality of refined stock discharged from both refining zones of the refiner, better optimizes efficiency, and increases and better balances refiner throughput.

According to still another aspect of a preferred embodiment, the inducer is coupled to the shaft in a manner that provides sufficient space between the outermost radial edge of the inducer and the interior of the inlet for the refiner to enable any contaminants or debris contained within the low consistency stock to be diverted or removed from the stock inlet flow and deposited in an area of the inlet separate from the entrances to the pairs of refining disks. By doing so, an inducer constructed in accordance with the invention that achieves this aspect reduces and preferably minimizes the impact of any such contaminants or debris on stock flow while also reducing refining surface wear.

In one preferred embodiment, the inducer is formed to include a number of vanes extending radially outward from and circumferentially around a central housing of the inducer connected to the rotating shaft so as to help control the flow of low consistency stock into the refiner. Depending upon the particular type of low consistency stock material or the particular flow attributes or rotation desired for the incoming flow of the low consistency stock, the configuration of the vanes on and/or the rotational speed of the inducer can be varied as necessary to achieve the desired results. Thus, the incoming stock material flow can be manipulated or pumped by the inducer to flow more evenly between the separate pairs of disks in the refiner. The vanes preferably are spaced from the inner edge of the inlet for the low consistency stock material to enable any foreign bodies contained within the stock material to be removed from the incoming stock material and deposited in an area of the inlet spaced from the actual refining disks of the refiner. Further, in the case of any clumps of fibers found in the incoming low consistency stock, the vanes serve to agitate the stock material to prevent the formation of clumps and also break up the fibers forming any already-existing clumps in order to provide the refiner disks with a more uniform stock material for refining.

In a still further aspect, the effect the inducer has on the flow of low consistency stock that has entered a double disk refiner helps reduce the pressure drop across a perforate hub of the refiner that is disposed between the refining zones of the refiner. In one preferred embodiment, the inducer imparts a rotation or spin to the low consistency stock at a rate of rotation or spin that better matches that of the perforate hub, which decreases pressure drop across the hub by reducing the magnitude of stock fluid shear by the hub. Reducing the pressure drop increases stock flow through the perforate hub which better balances stock flow through both refining zones of the double disk refiner.

One preferred inducer has at least one helically shaped flight with a leading edge that is canted relative to the general direction of flow of low consistency stock along the shaft carrying the inducer. Such a canted leading edge helps impact clumps to break them up while minimizing the creation of retarding eddies and turbulence. As a result of the flight being helical, rotation of the shaft causes the flight to propel or pump the stock toward both refining zones. Preferably, at least a slight rotation or spin is imparted by the inducer to the stock.

Another preferred inducer has a plurality of helically shaped flights that each has a leading edge that is canted relative to the general direction of flow of low consistency stock along the shaft carrying the inducer. Each flight also has a canted trailing edge. Such a canted leading edge helps impact clumps to break them up while minimizing the creation of retarding eddies and turbulence. Such a canted trailing edge reduces and preferably prevents cavitation during operation.

In still another preferred embodiment, the inducer comprises a turbulator having a plurality of curved flights disposed along the flow path of low consistency stock that has entered the double disk refiner that need not rotate in unison with the refiner rotor shaft. Preferably, each such flight extends along the shaft in a direction generally parallel to the rotational axis of the shaft.

Advantages of the present invention include at least one of the following: only a single inducer is needed, an inducer constructed in accordance with the invention is of simple and economical construction, an inducer made in accordance with the invention is durable and long-lasting, an inducer made in accordance with the invention improves refiner performance by reducing low consistency stock pressure drop between the refining zones of a double disk refiner, Various additional features, embodiments and alternatives of the present invention will be made apparent from the following detailed description taken together with the claims.

BRIEF DESCRIPTION OF THE DRAWINGS

Preferred exemplary embodiments of the invention are illustrated in the accompanying drawings in which like reference numerals represent like parts throughout and in which.

Figure 1:
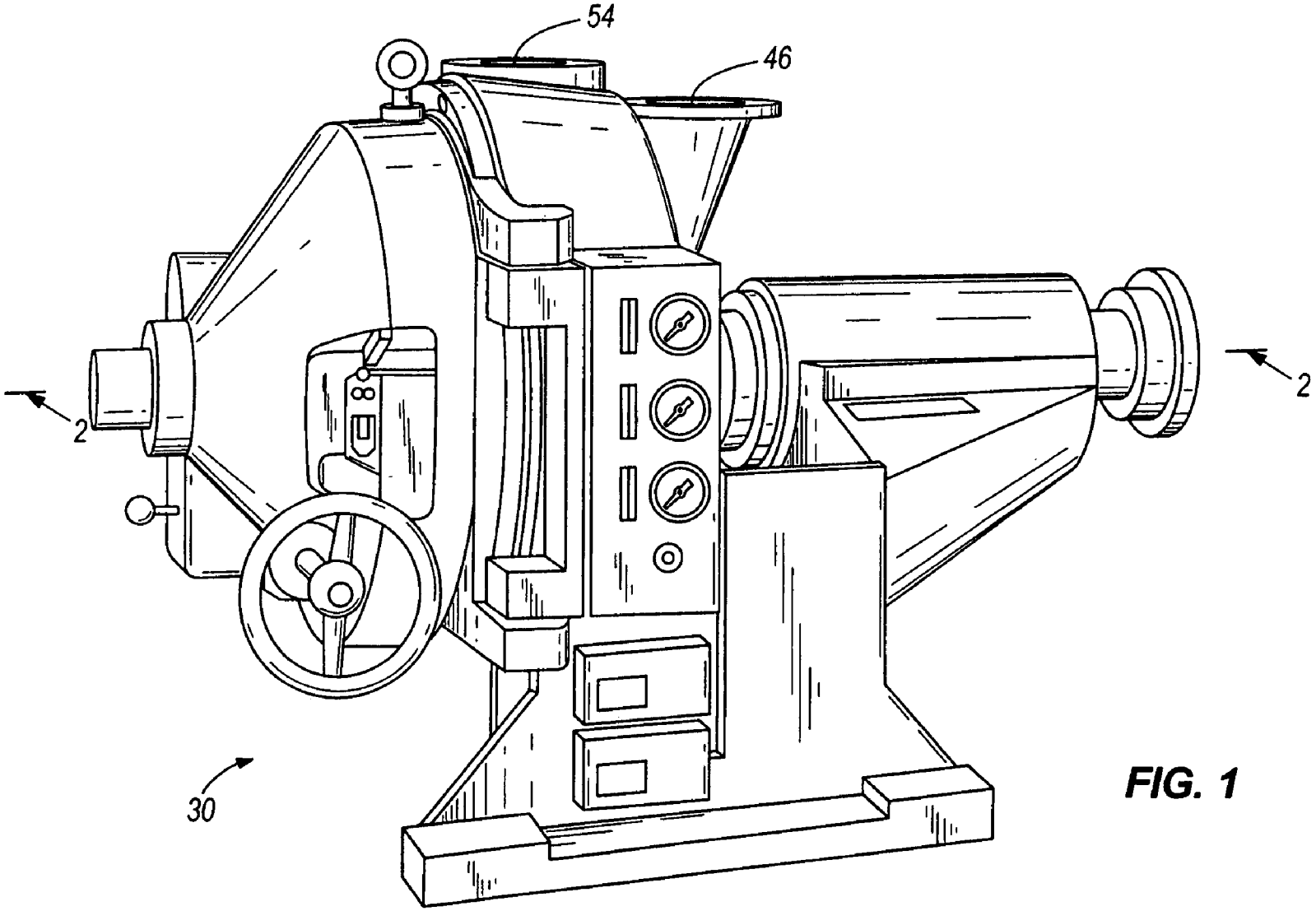
FIG. 1 is an isometric view of a double disk refiner used to refiner low consistency stock.

Before explaining embodiments of the invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE DRAWINGS

Figure 2:
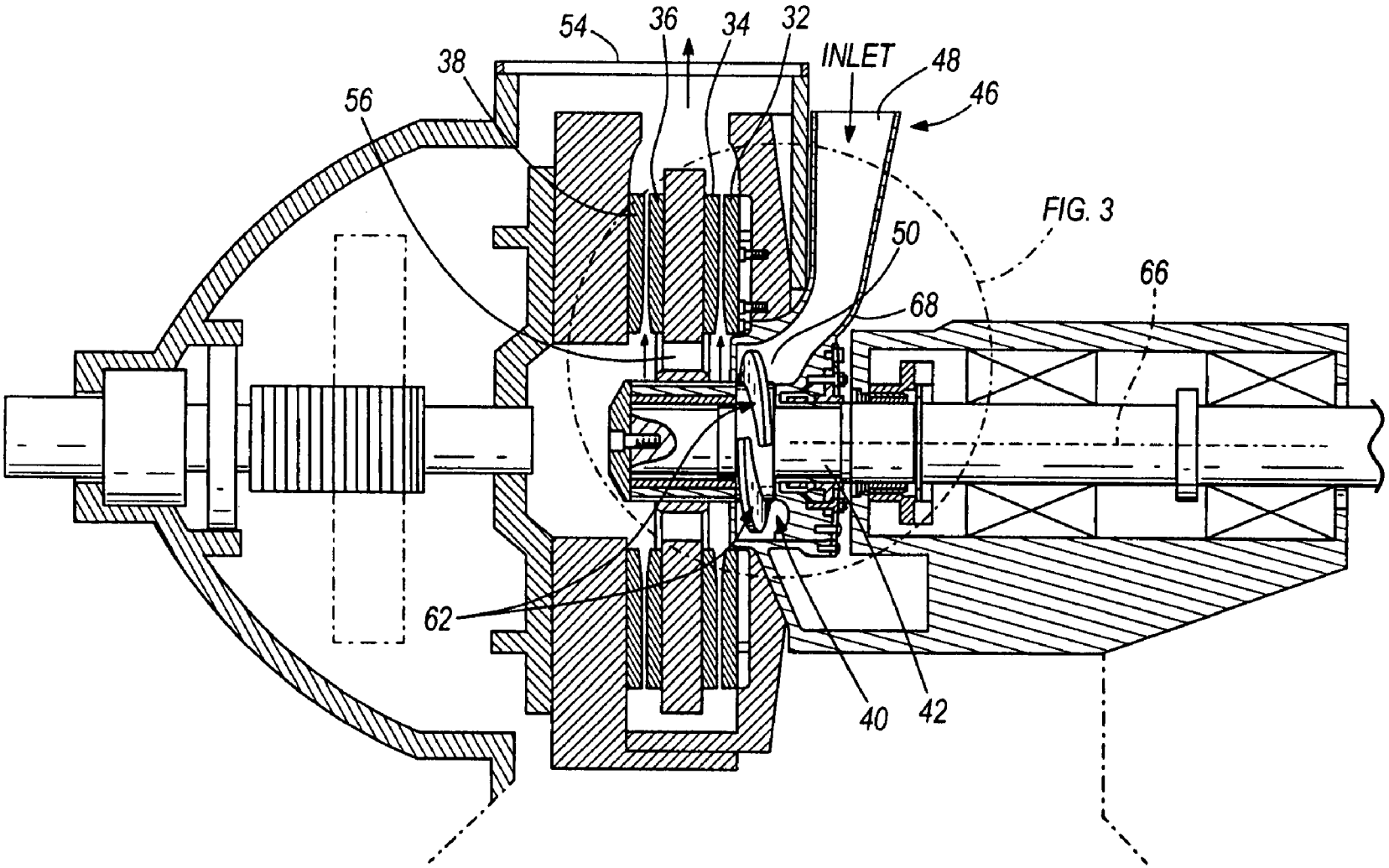
FIG. 2 is a cross-sectional view along line 2—2 of FIG. 1.

FIGS. 1 and 2 illustrate an exemplary embodiment of a double disk refiner 30, such as a Beloit-Jones DD 3000 refiner, that is used to refine low consistency stock. The double disk refiner 30 includes an outer housing 31 in which are disposed two pairs of parallel, opposed refiner disks 32, 34 and 36, 38 that each refine fiber in the low consistency stock charged to the refiner 30 substantially simultaneously by grinding or fibrillating the fiber in the stock.

Figure 3:
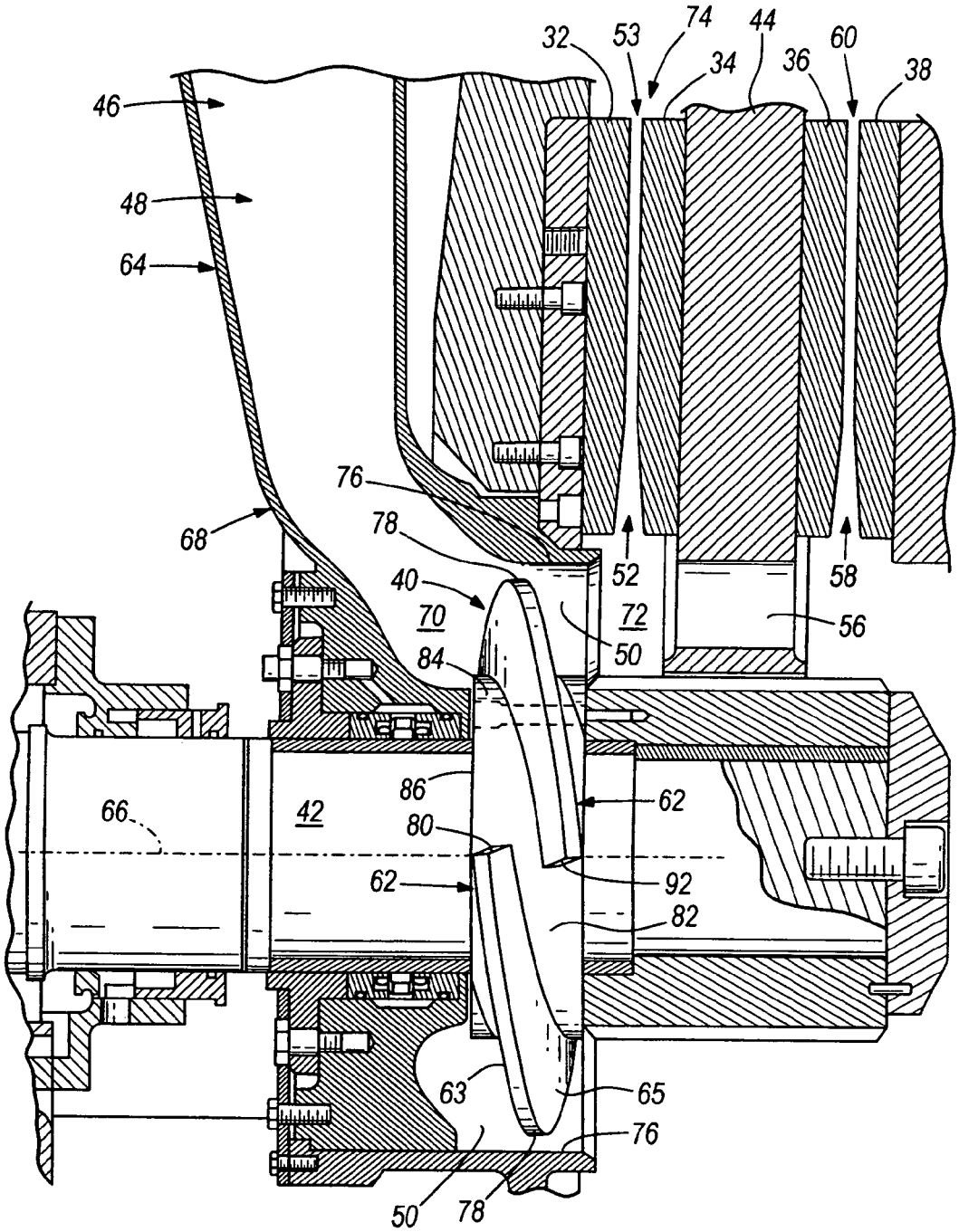
FIG. 3 is a fragmentary cross-sectional view along line 3—3 of FIG. 2.

Referring additionally to FIG. 3, the double disk refiner 30 of the present invention is preferably used in conjunction with a stock inducer 40 disposed within the housing 31 adjacent the disks 32–38 in low consistency double disk stock refining applications where the stock being refined has no more than about six (6) percent fiber by weight. Preferably, the inducer 40 is well suited for use in low consistency stock refining applications where there is between 2.5 percent and 5.5 percent fiber by weight.

During operation of the refiner 30, an input shaft 42 that is coupled to a rotor 44 that carries one refiner disk 34 and 36 of each disk pair, respectively, is rotated, causing both refiner disks 34, 36 to rotate in unison with the shaft 42. The low consistency stock enters the refiner 30 through an inlet 46 where it flows downwardly through an inlet passageway 48 toward the shaft 42 until it reaches an intake chamber 50 that is located upstream of the first pair of opposed refiner disks 32, 34. At least some of the low consistency stock flows radially outwardly of the chamber 50 through a gap 52 between the first pair of disks 32, 34 which forms a first refining zone 53 for the first pair of disks 32, 34. The fiber in the low consistency stock is refined as it passes through the first refining zone 53 between the first pair of disks 32, 34 in a conventional manner. The refined low consistency stock then exits from the first refining zone 53 between the disks 32, 34 toward a radially outwardly located discharge 54, best shown in FIGS. 1 and 2, through which the stock can exit the refiner 30 for further processing in order to form paper.

At least some of the remainder of the low consistency stock not passing through the first refining zone 53 flows through one or more ports 56 disposed in the rotor 44 inwardly of the disk 34. The stock flows through the ports 56 until the stock reaches the second pair of opposed refiner disks 36, 38. However, the refiner 30 can be constructed to have as many spaced pairs of refiner disks as desired on the shaft 42. The portion of the low consistency stock reaching the second pair of disks 36, 38 then flows radially outwardly through a gap 58 defined between the second pair of disks 36, 38 that forms a second refining zone 60. The fiber in this portion of the low consistency stock is refined as it passes through the second zone 60 between the second pair of disks 36, 38 in the same manner as the stock flowing through the first zone 53. This refined stock portion then exits the second zone 60 between the second pair of disks 36, 38, flows radially outwardly toward the discharge 54 to be combined with the refined stock portion exiting the first zone 53, and exits the discharge 54.

The inducer 40 is formed of a generally rigid material and is positioned on the shaft 42 within the intake chamber 50 immediately upstream of the first pair of disks 32, 34. As the low consistency stock flows out of the passageway 48 and into the intake chamber 50, the inducer 40 rotates in conjunction with the shaft 42 such that a number of radially outwardly extending vanes or flights 62 on the inducer 40 mix the fiber in the low consistency stock to prevent clumping and/or to break up any clumps that have already formed in the stock material. The inducer 40 also advantageously propels or pumps the stock in a direction generally parallel to the axis of rotation of the shaft 42 and through the intake chamber 50, thereby changing the momentum of the stock. As a result, the fiber in the stock is more uniformly distributed as it enters the refining zone 53 between the first pair of disks 32, 34, which leads to increased throughput and increased refining efficiency. It also helps ensure that a sufficient portion of the stock reaches and is refined by is being refined by the second pair of disks 36, 38 and that this portion also has a more uniform fiber distribution. This is accomplished in part by the inducer 40 imparting a rotation to the incoming low consistency stock flow which serves to both lessen the clumping of the fibers in the stock and carry or urge a significant portion of the stock through the ports 56 in the rotor 44 to the second pair of disks 36, 38. Additionally, this reduction in the number of clumps and more uniform distribution of the fiber in the low consistency stock permits the gap 52 between the first pair of disks 32, 34 to be increased without reducing the uniformity of the stock existing the gap 52, which can desirably increase the amount of fiber-on-fiber fibrillation that can take place in the first zone 53. Preferably, the positioning of the inducer 40 upstream of both pairs of disks 32, 34 and 36, 38, permits the gap 58 between the second pair of disks 36, 38 to be similarly increased in size, leading to similar benefits regarding the fibrillation of the fibers in the low consistency stock between the disks 36, 38.

Referring still to FIG. 3, the stock inlet passageway 48 has a generally straight section 64 that is positioned generally perpendicular to the axis of rotation 66 of the input shaft 42. The inlet passageway 48 also includes a bend 68 that is acutely angled relative to the rotational axis 66 of the shaft 42. The inlet passageway 48 terminates at a mouth 70 disposed adjacent the annular intake chamber 50. The intake chamber 50 communicates with an entranceway 72 of the refining zone 53 of the first pair of disks 32, 34. The refining zone 53 extends completely between the disks 32, 34 from a spot adjacent the entranceway 72 to an outer radial periphery 74 of the disks 32, 34.

The inducer 40 is specifically disposed within the intake chamber 50 adjacent the mouth 70 of the stock inlet passageway 48. Each flight 62 on the inducer 40 preferably extends radially outwardly a sufficient extent such that, as the inducer 40 rotates, the flight 62 nearly touches a pair of opposed sidewalls 76 that define at least a portion of the intake chamber 50. For example, if the chamber 50 is square, the flight 62 nearly touches the center of each of the top, bottom and side walls of the chamber 50. Further, if the chamber is round, and the side walls 76 form a continuous wall for the chamber 50, the flight 62 is spaced a constant distance from the side walls 76 throughout the rotation of the flight 62 and the inducer 40. In one preferred embodiment, each flight 62 has an outer radial edge 78 that is spaced no closer to the intake sidewalls 76 than about ⅛ of an inch and no farther away than about ¾ of an inch. The spacing for the flight 62 is selected so as to ensure that the outer radial edge 78 of each flight 62 is disposed close enough to be located within a zone of laminar fluid present at the sidewall 76 during operation of the refiner 30 to help prevent any backflow of the low consistency stock within the chamber 50. This helps provide a good seal between the flights 62 of the inducer 40 and the sidewall 76 to help ensure efficient operation of the inducer 40. Additionally, such spacing also is designed to be large enough to allow various types of debris (not shown) that can be present in the stock, such as stones, to pass between the flight 62 and the sidewall 76 into a waste collection area at the bottom of the chamber 50 and not through the chamber 50 to the pair of disks 32, 34 and/or 36, 38.

In a preferred embodiment, the inducer 40 has an axial length of no more than about five (5) inches such that the inducer 40 is compact in construction and can be completely contained in the intake chamber 50, yet provides enough surface area on the flights 62 to not only uniformly mix the fibers in the stock but to propel the low consistency stock outwardly from the chamber 50 as well. Such dimensions also enable each inducer 40 to be constructed with flights 62 having a sufficient axial length that preferably completely overlie the mouth 70 such that substantially all of the low consistency stock entering the intake chamber 50 from the passageway 48 comes into contact with the inducer 40.

The inducer 40 is positioned in the chamber 50 such that a leading edge 80 of each flight 62 on the inducer 40 passes into and through the mouth 70 of the inlet passageway 48 during rotation of the inducer 40. As the leading edge 80 passes upwardly into and though the mouth 70, the edge 80 contacts and breaks up clumps of fiber present in the low consistency stock entering the intake chamber 50. Additional rotation of the inducer 40 causes the remainder of the flight 62 trailing the leading edge 80 to pass also through the mouth 70 and urge the stock out of the mouth 70 and toward the refining zone entranceway 72 and the pairs of refiner disks 32, 34 and 36, 38.

The flights 62 of the inducer extend outwardly from a hub 82 that preferably is cylindrical, but can also have other shapes depending upon the shape of the shaft 42, and that is positioned around and received on the input shaft 42. While the hub 82 can be keyed to the shaft 42 for rotation in unison therewith, it preferably is attached to the shaft 42 by a plurality of axially extending fasteners 84, only one of which is shown in FIG. 3. In the preferred mounting arrangement depicted in FIG. 3, each fastener 84 extends from a front face 86 of the hub 82 completely through the hub 82 until it is received in a threaded bore located in the rotor 44. Despite using fasteners 84 in the preferred embodiment, in other embodiments the hub 82 can be keyed to the shaft 42, keyed to the rotor 44, or to both.

Figure 4:
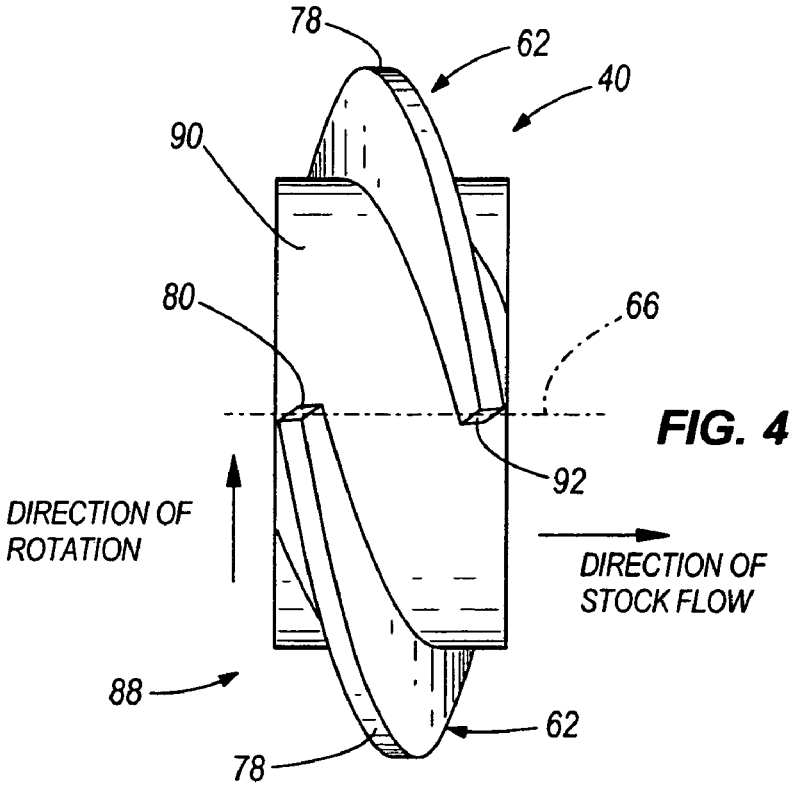
FIG. 4 is a top view of the stock inducer shown in FIG. 3.
Figure 5:
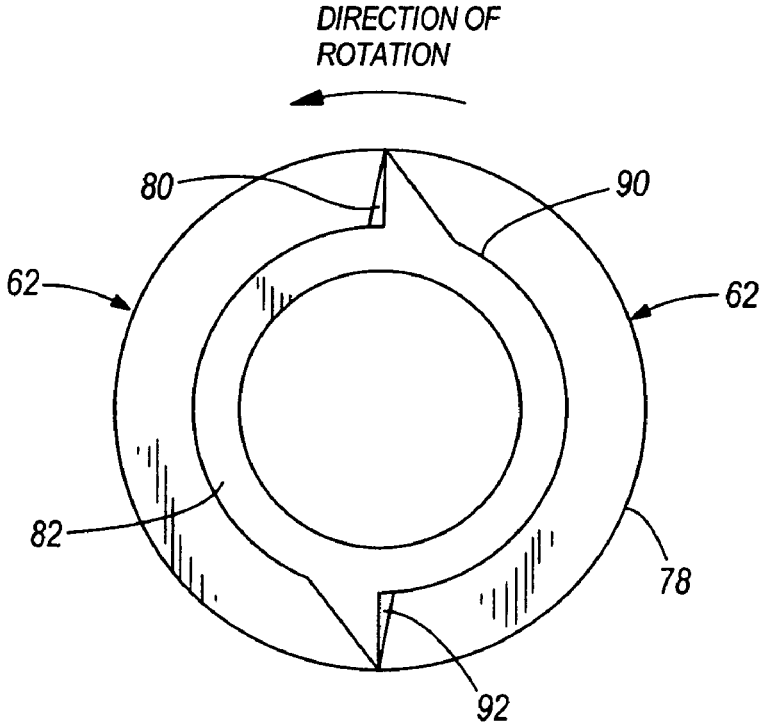
FIG. 5 is a front end view of the stock inducer.

The preferred embodiment of the inducer 40 depicted in FIG. 3 is also shown in FIGS. 4 and 5. In this preferred embodiment, the inducer 40 is formed as an impeller 88 that has a plurality of curved flights 62 disposed on the hub 82 that are each preferably helical and continuously curved. The two flights 62 each encompass at least one-hundred twenty (120) degrees of the circumference of the outer periphery 90 of the hub 82. In a particularly preferred embodiment, each one of the helical flights 62 encompasses no greater than about one-hundred ninety (190) degrees of the circumference of the periphery 90 and can overlap each other along their adjacent ends, if desired. Each flight 62 also preferably has a generally rectangular cross section and is depicted in FIG. 3 having generally rectangularly shaped leading and trailing edges 80, 92.

Further, in the preferred embodiment of the inducer 40 shown in FIG. 3, the helical flights 62 are axially spaced from one another, but have between two (2) and seven (7) degrees of circumferential overlap as defined along the axis of rotation 66. This overlap is preferred because it helps prevent cavitation of the low consistency stock being propelled by the inducer 40 into the refiner 30 while simultaneously permitting any debris in the stock to pass between the flights 62 in either direction. The overlap also provides a significant increase in the surface area of each flight 62 used to propel the low consistency stock, which increases the efficiency of the refiner 30 because the stock throughput is consequently increased. The overlap is still further desired as it ensures that the low consistency stock is continuously propelled by the impeller 88 toward the pairs of refiner disks 32, 34 and 36, 38. This helps maximize the flow rate of the low consistency stock through the refiner 30.

In an alternative embodiment (not shown), the impeller 88 can have a single flight 62. Where a single flight 62 is used, the flight 62 preferably encompasses at least three hundred sixty (360) degrees of the circumference of the periphery of the hub 82. Preferably, its ends overlap but are axially spaced apart from each other. In still another alternative embodiment (not shown), the impeller 88 can have four flights 62 that each overlap an adjacent flight 62 and encompasses a circumferential extent of at least ninety (90) degrees.

Figure 7:
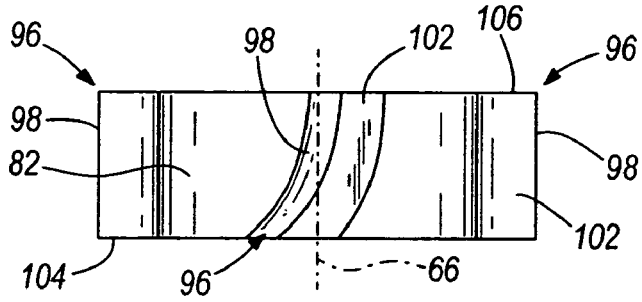
FIG. 7 is a top view of the stock inducer shown in FIG. 6.

FIGS. 6–9 illustrate three views of a second preferred embodiment of an inducer 94. This inducer 94 has a hub including four generally equiangularly spaced apart flights 96 that each comprise a radially outwardly extending arm 97 that is curved but not helical. Preferably, each flight 96 is continuously curved and encompasses a section of the circumference of no more than ninety (90) degrees and preferably no more than forty-five (45) degrees of the hub 82. The flights 96 do not overlap so as to easily permit debris to pass between them. Each flight 96 extends in a generally axial direction and is curved relative to the axis of rotation 66 of the inducer 94 along its axially-extending radial edge 98 and is also similarly curved along its base 100. Preferably, each flight 96 has a web 102 between its radial edge 98 and the base 100 that is curved both in an axial direction and in cross section to conform to the configuration of both the edge 98 and the base 100. The axially-extending radial edge 98 is oriented at an angle of between five (5) degrees and thirty (30) degrees with respect to a tangent found at a midpoint of the edge 98 (FIG. 7).

Figure 6:
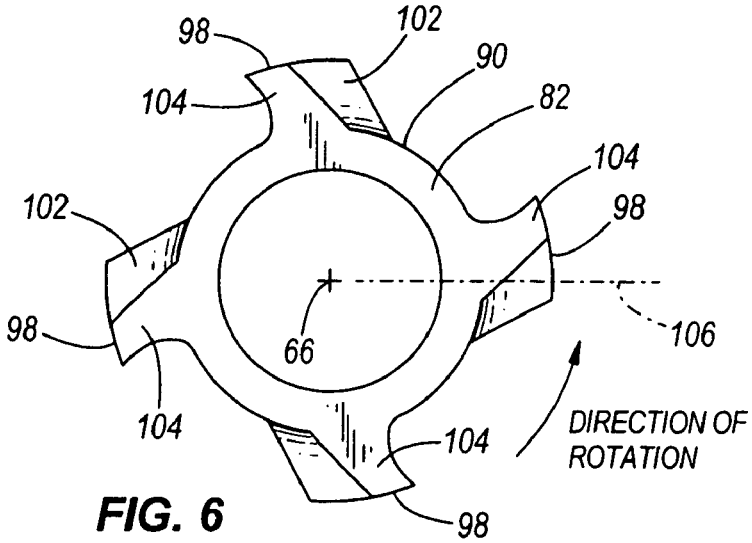
FIG. 6 is a front end view of a second preferred embodiment of a stock inducer showing one end of the stock inducer.

Referring specifically to FIG. 6, each flight 96 has a leading axial edge 104 disposed toward the mouth 70 that is angled away from the direction of rotation at an angle of between five (5) degrees and forty (40) degrees relative to a plane 106 that extends through the shaft axis of rotation 66 and the flight 96.

Figure 9:
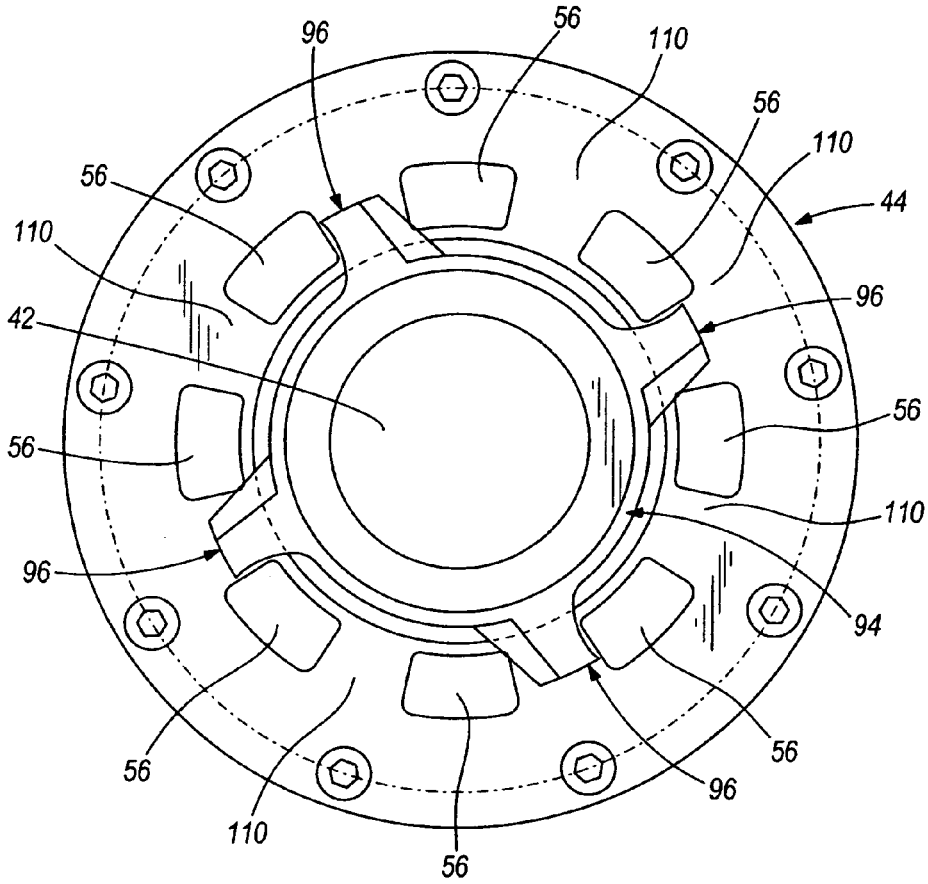
FIG. 9 is a front end view of the stock inducer mounted to a shaft that carries a rotor of the refiner.

As is shown in FIG. 9, each flight 96 also has a trailing axial edge 108 facing away from the mouth 70 that is angled similarly to the portions of the flight 96. Such an angular profile advantageously maximizes mixing of the stock while minimizing cavitation. The selection of the specific angle to curve each flight 96 is selected to help ensure that the inducer 94 substantially continuously propels fluid toward the two pairs of refiner disks 32, 34 and 36, 38 while simultaneously uniformly mixing the fiber in the stock and breaking up any fiber clumps present.

Figure 8:
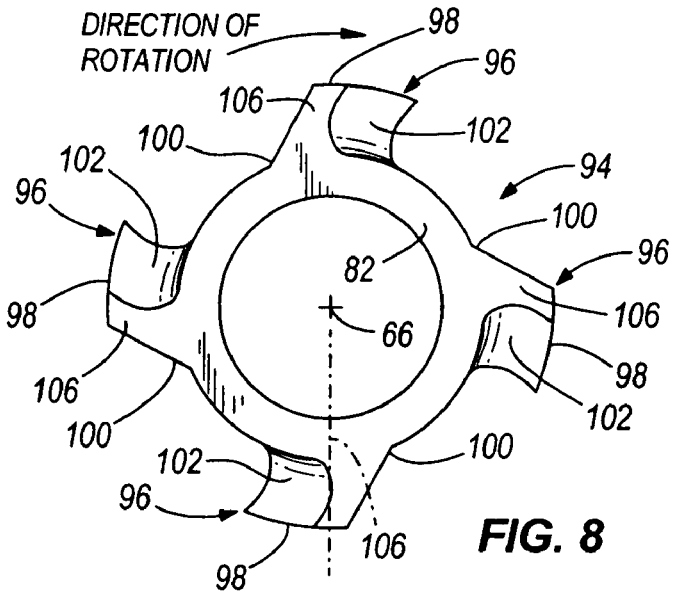
FIG. 8 is a rear view of the stock inducer showing its other end.

FIG. 9 also illustrates the inducer 94 shown in FIGS. 6–8 mounted to the input shaft 42 adjacent the rotor 44. The inducer 94 is oriented with each flight 96 disposed axially in front of a spoke 110 disposed on the rotor 44, in a manner that avoids blocking any rotor port 56. By not blocking flow through any port 56, the inducer 94 advantageously encourages stock flow not just to the first pair of refiner disks 32, 34, but also through the rotor 44 to the second pair of disks 36, 38.

Figure 12:
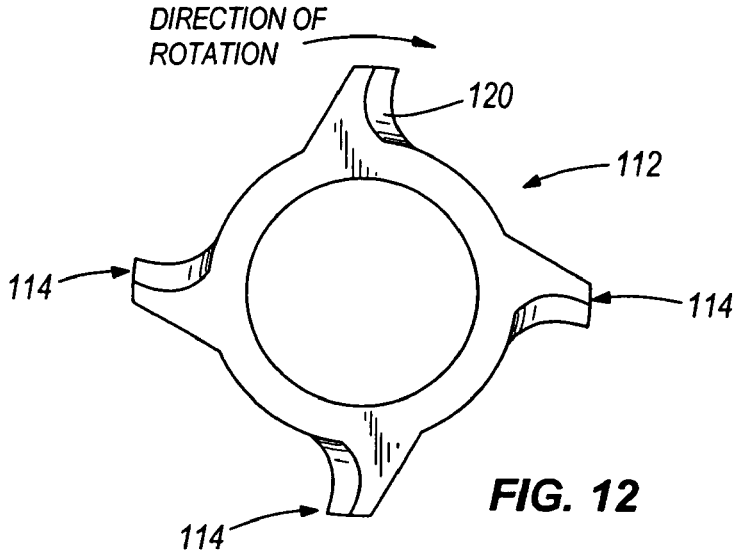
FIG. 12 is a rear end view of the stock inducer showing its other end.
Figure 11:
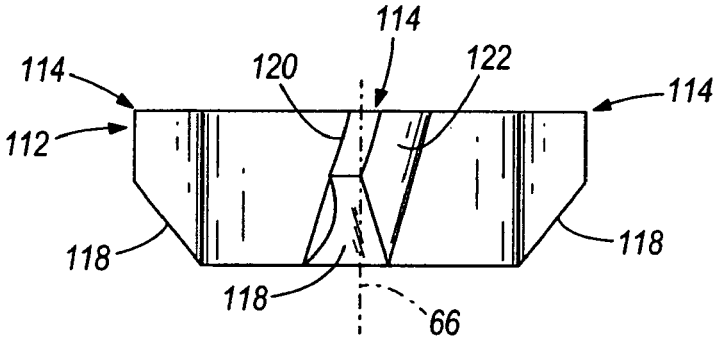
FIG. 11 is a top view of the stock inducer shown in FIG. 10.
Figure 10:
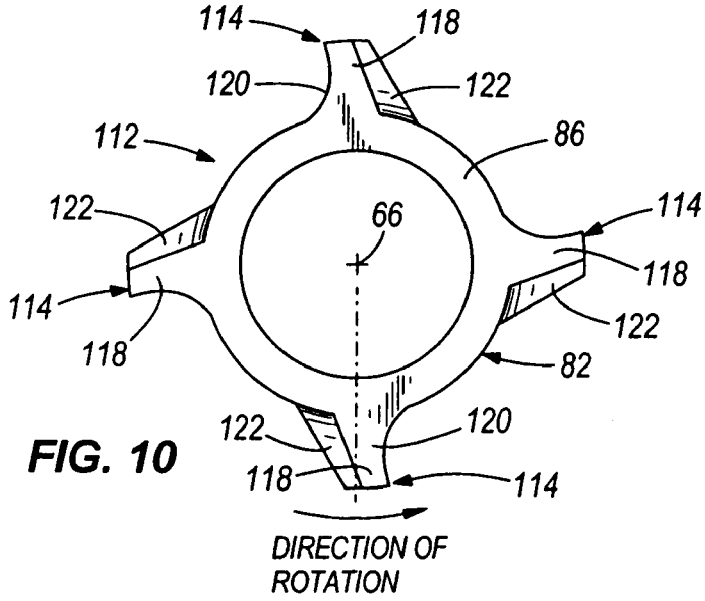
FIG. 10 is a front end view of a third preferred embodiment of a stock inducer showing one end of the stock inducer.

FIGS. 10–12 illustrate three views of a third preferred embodiment of an inducer 112 to be used with the refiner 30. The inducer 112 is similar in construction to the inducer 94, but each flight 114 has a straight, axially-extending radial edge 116. Each leading axial edge 118 is canted away from the front face 86 of the hub 82, which is generally perpendicular to the axis of rotation 66. Each flight 114 also has a leading surface 120 that is curved or chamfered and a trailing surface 122 that is straight or substantially planar. The curved leading surface 120 aggressively helps uniformly mix the fibers present in the low consistency stock, while the generally planar trailing surface 122 helps minimize cavitation.

Figure 13:
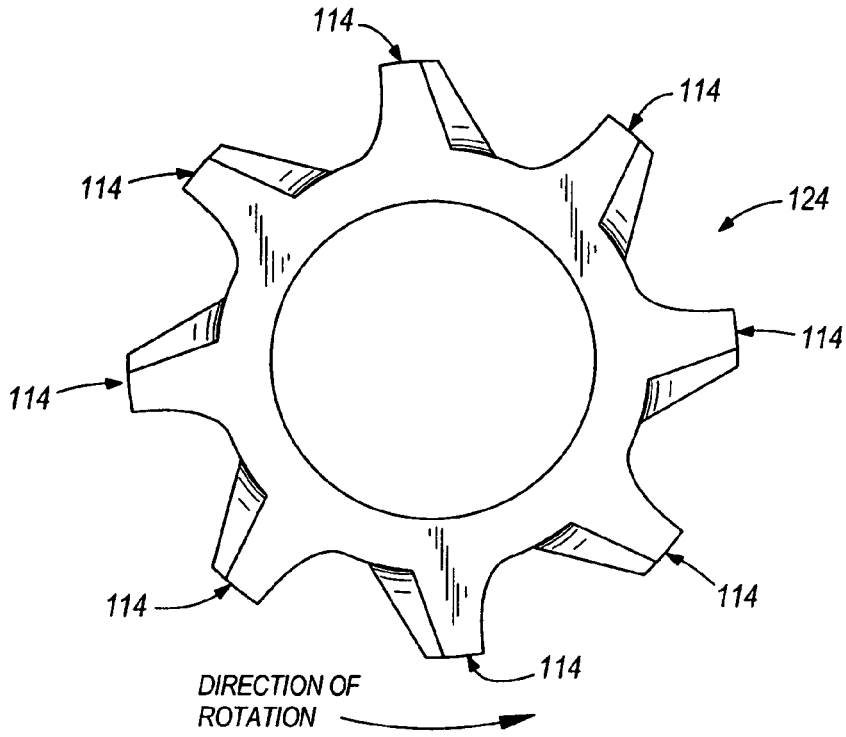
FIG. 13 is a front end view of a fourth preferred embodiment of a stock inducer showing one end of the stock inducer.

FIG. 13 depicts still a fourth preferred embodiment of an inducer 124 that has eight flights 114 that preferably are equiangularly spaced from one another on the hub 82 and are constructed the same as or similar to the flights 114 of the inducer 112 shown in FIGS. 10–12.

The rigid material used to form each inducer 40, 94, 112 or 124 preferably is a metal, such as stainless steel, that has adequate corrosion resistance. A particularly preferred material is CA-40 steel as this provides good corrosion resistance, good toughness, and good cavitation resistance.

Referring once again to FIG. 3, in operation, the low consistency stock enters the inlet 46 and travels radially inwardly toward the rotating input shaft 42. As the stock reaches the bend 68, the flights 62 on the rotating inducer 40 pull the low consistency stock into the intake chamber 50, agitate or mix the stock, and propel the stock toward the refining zone entranceway 72. Stock propelled by the inducer 40 ultimately enters the first refining zone 53 of the first pair of refiner disks 32, 34 and the second refining zone 60 of the second pair of disks 36, 38. Preferably, the shaft 42 and inducer 40 rotate at a speed of between four hundred (400) revolutions per minute and one thousand (1,000) revolutions per minute. Preferably, the shaft 42 and inducer 40 rotate at a rotational speed that produces a flight 62 outer tip speed of between four thousand five hundred (4,500) feet per minute and six thousand one hundred (6,100) feet per minute.

Fiber in the low consistency stock entering the inducer 40 is thoroughly mixed by contact between each flight 62 of the inducer 40 and the stock. More specifically, the leading edge 80 of each flight 62 contacts the stock, producing a shearing action that facilitates mixing. Also, the leading surface 63 (FIG. 3) of each flight 62 propels the stock axially toward the rotor 44 also helping to mix and more uniformly distribute the fiber in the stock. Further, the trailing surface 65 (FIG. 3) of each flight produces a turbulent wake behind it, which additionally facilitates mixing of the stock. As a result, any fiber that has clumped together or accumulated at or adjacent the bend 68 or the mouth 70 is broken up and more uniformly mixed in the low consistency stock before it enters the refining zones 53 and 60 of each pair of refiner disks 32, 34 and 36, 38.

Due to the rotation of the inducer 40, the stock entering both refining zones 53 and 60 is better and more uniformly mixed enabling the respective refining gaps 52, 58 to be increased between one (0.001) and three (0.003) thousandths of an inch. For both the gap 52 and the gap 58, the width of each gap can range between 0.005 inches (0.127 mm) and 0.125 inches (3.175 mm), with each gap being no greater than 0.200 inches (5.08 mm), to maximize the operation of the refiner 30 including the inducer 40. This increase in the widths of each gap 52, 58 advantageously promotes fiber-on-fiber fibrillation, which increases both strength and toughness of the resultant fiber product produced. In addition to a more uniform mixture of the stock and reducing plate clashing by maintaining a more uniform gap throughout both refining zones 53, 60, plate clashing is further reduced because the pairs of disks 32, 34 and 36, 38 are spaced farther apart from one another. As a result of the disks 32, 34 and 36, 38 being spaced farther apart, each refining zone 53, 60 can accommodate a greater volumetric flow rate of the low consistency stock, which means that a greater amount of stock can be refined in a given period of time. In the end, refining quality, quantity, and consistency are all improved while plate clashing is reduced and preferably substantially completely prevented, leading to an increased useful life for the refiner disks 32–38. All of this is achieved preferably using a single inducer 40 located upstream of both pairs of refiner disks 32, 34 and 36, 38.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention.

The invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. A refiner comprising:

a housing having an inlet for receiving slurry;

a shaft extending through the housing, defining an axis, and being rotatable about the axis and relative to the housing;

a rotor connected to the shaft, at least partially defining a first refining zone and a second refining zone, and including a channel fluidly connecting the second refining zone and the stock inlet; and an inducer carried by the shaft and positioned adjacent to the channel and upstream from the first refining zone to direct a quantity of the slurry through the channel toward the second refining zone.

2. The refiner according to claim 1 wherein the inducer comprises a hub connected to the shaft for rotation therewith and a plurality of helical flights extending outwardly from the hub.

3. The refiner according to claim 2 wherein the hub includes a generally cylindrical outer surface, and wherein at least one of the plurality of helical flights extends circumferentially around at least about 120 degrees of the outer surface.

4. The refiner according to claim 3 wherein each one of the helical flights encompasses less than about 180 degrees of circumferential extent about the outer surface of the hub.

5. The refiner according to claim 1 wherein the inducer comprises a hub connected to the shaft for rotation therewith and a plurality of flights extending outwardly from the hub, each of the plurality of flights having a leading edge disposed at an angle of at least about 5 degrees relative to a plane extending through the axis of the shaft and the flight.

6. The refiner according to claim 5 wherein the leading edge of each flight is disposed at an angle of less than about 40 degrees relative to the plane.

7. The refiner according to claim 6 wherein the leading edge of each flight is substantially straight.

8. The refiner according to claim 1 wherein the inducer comprises a hub connected to the shaft for rotation in unison therewith and a plurality of flights extending outwardly from the hub, each of the plurality of flights having an axial edge disposed at an angle of at least 5 degrees relative to a plane extending through the axis of the shaft and the flight.

9. The refiner according to claim 8 wherein a leading edge of each flight is disposed at an angle of no greater than about 30 degrees relative to the plane.

10. The refiner according to claim 9 wherein the axial edge of each flight is substantially straight.

11. The refiner according to claim 1 wherein the inlet has a throat disposed adjacent the inducer, the inducer is disposed along the axis of the shaft at an acute angle or a right angle relative to a longitudinal axis of the inlet, and the inducer has an axial length that substantially spans the throat.

12. The refiner according to claim 11, wherein the inducer includes a plurality of outwardly extending flights, and wherein the flights substantially span the width of the throat.

13. The refiner according to claim 11 further comprising a plurality of pairs of refiner disks disposed adjacent the inducer and opposed to each other but spaced apart so as to create a gap therebetween, the gap communicating with an intake chamber downstream of the throat of the inlet.

14. The refiner according to claim 13, wherein the inducer includes a plurality of outwardly extending flights, and wherein each flight of the inducer terminates upstream of the intake chamber.

15. The refiner according to claim 1, wherein the inducer includes a plurality of outwardly extending flights oriented to direct a second quantity of the slurry outwardly toward the first refining zone.

16. The refiner according to claim 1, wherein the inducer includes a plurality of outwardly extending flights oriented to distribute slurry between the first refining zone and the second refining zone.

17. The refiner according to claim 16, wherein the inducer mixes the slurry before distributing the slurry to the first refining zone and the second refining zone.

18. The refiner according to claim 1, wherein the inducer includes a plurality of outwardly extending flights, the plurality of flights preventing backflow toward the inlet between the inducer and the housing.

19. The refiner according to claim 1, wherein the inducer includes an outwardly extending flight having an accurately shaped outer edge.

20. The refiner according to claim 1, wherein the inducer includes an outwardly extending flight having a trailing surface for generating turbulence in the slurry to mix the slurry.

21. A refiner comprising:

a housing having an inlet for receiving slurry;

a shaft extending through the housing, defining an axis, and being rotatable about the axis and relative to the housing;

a first pair of opposed refiner disks, at least one disk of the first pair of disks being rotatable with the shaft about the axis;

a second pair of opposed refiner disks; and an inducer connected to the shaft for rotating movement with the shaft to distribute the slurry between the first pair of opposed refiner disks and the second pair of opposed refiner disks, the inducer terminating upstream from the first pair of opposed refiner disks.

22. The refiner according to claim 21, wherein the first pair of opposed refiner disks at least partially define a first refining zone and the second pair of opposed refiner disks at least partially define a second refining zone, and further comprising a rotor connected to the shaft for rotating movement with the shaft, the rotor including a channel extending between the first refining zone and the second refining zone.

23. The refiner according to claim 22, wherein the inducer is positioned adjacent to the channel and the first refining zone to direct at least some of the slurry through the channel toward the second refining zone.

24. The refiner according to claim 21, wherein the inducer mixes the slurry before distributing the slurry to the first pair of opposed refiner disks and the second pair of opposed refiner disks.

25. The refiner according to claim 21, wherein the inducer includes a plurality of outwardly extending flights, the plurality of flights preventing backflow toward the inlet between the inducer and the housing.

26. The refiner according to claim 21, wherein the inducer includes an outwardly extending flight having an accurately shaped outer edge.

27. The refiner according to claim 21, wherein the inducer includes an outwardly extending flight having a trailing surface for generating turbulence in the slurry to mix the slurry.

28. A refiner comprising:

a housing having an inlet for receiving slurry;

a shaft extending through the housing, defining an axis, and being rotatable about the axis and relative to the housing;

a pair of opposed refiner disks, at least one disk of the pair of disks being rotatable with the shaft relative to the housing; and an inducer having an arcuately-shaped flight and being connected to the shaft for rotating movement with the shaft to mix the slurry, the flight terminating upstream from the pair of opposed refiner disks.

29. The refiner according to claim 28, further comprising a second pair of opposed refiner disks, and wherein the inducer distributes the slurry between the first pair of opposed refiner disks and the second pair of refiner disks.

30. The refiner according to claim 29, wherein the first pair of opposed refiner disks at least partially defines a first refining zone and the second pair of opposed refiner disks at least partially defines a second refining zone, and further comprising a rotor connected to the shaft and including a channel fluidly connecting the second refining zone and the stock inlet.

31. The refiner according to claim 30, wherein the inducer is positioned adjacent to the channel and the first refining zone to direct at least some of the slurry through the channel toward the second refining zone.

32. The refiner according to claim 28, further comprising a second pair of opposed refiner disks, and wherein the inducer includes a plurality of outwardly extending flights oriented to distribute the slurry between the first pair of opposed refiner disks and the second pair of opposed refiner disks.

33. The refiner according to claim 28, wherein the inducer includes a plurality of outwardly extending flights, the plurality of flights preventing backflow toward the inlet between the inducer and the housing.

34. The refiner according to claim 28, wherein the inducer includes an outwardly extending flight having a trailing surface for generating turbulence in the slurry to mix the slurry.

* * * * *